US008006391B1

(12) United States Patent
Mashburn et al.

(10) Patent No.: US 8,006,391 B1
(45) Date of Patent: Aug. 30, 2011

(54) RELEASABLE LOCKING MECHANISM FOR THE SHANK OF A KNIFE OR OTHER IMPLEMENT

(76) Inventors: Ronald G. Mashburn, Sherwood, AR (US); Larry D. Mount, Harrison, AR (US)

( * ) Notice: Subject to any disclaimer, the term of this patent is extended or adjusted under 35 U.S.C. 154(b) by 519 days.

(21) Appl. No.: 12/013,902

(22) Filed: Jan. 14, 2008

(51) Int. Cl.
*B26B 1/00* (2006.01)

(52) U.S. Cl. ..... 30/339; 30/156; 30/329; 83/698.21; 83/13

(58) Field of Classification Search ..... 30/151–161, 30/329–331, 337–339, 392–394; 83/698.11, 83/698.21, 698.31, 13
See application file for complete search history.

(56) References Cited

U.S. PATENT DOCUMENTS

| | | | | |
|---|---|---|---|---|
| 4,777,725 | A | 10/1988 | Hirsch | |
| 5,575,071 | A | 11/1996 | Phillips et al. | |
| 5,903,983 | A | 5/1999 | Jungmann et al. | |
| 6,260,281 | B1 | 7/2001 | Okumura et al. | |
| 6,453,565 | B1 | 9/2002 | Phillips | |
| 6,546,633 | B1 | 4/2003 | Lovell et al. | |
| 6,612,039 | B2 | 9/2003 | Kakiuchi et al. | |
| 6,851,194 | B1 * | 2/2005 | Chen et al. | 30/392 |
| 7,003,888 | B2 * | 2/2006 | Bigden et al. | 30/392 |
| 7,040,023 | B2 | 5/2006 | Nemazi et al. | |
| 7,107,690 | B2 | 9/2006 | Lui et al. | |
| 2005/0252010 | A1 | 11/2005 | Freeman | |
| 2007/0169353 | A1 * | 7/2007 | Wu | 30/155 |

* cited by examiner

*Primary Examiner* — Phong H Nguyen
(74) *Attorney, Agent, or Firm* — Joe D. Calhoun; Rashauna A. Norment

(57) ABSTRACT

A releasably locking mechanism for locking and releasing the shank of a blade or other implement snugly within a receiver, wherein a magnetized ball extends through aligned holes in the shank and the first wall of the receiver, and seats in a smaller hole in the second wall of the receiver so that the equator of the ball is positioned on the side of the shank nearer to the second wall of the receiver. Unseating the ball and repositioning its equator to the opposite side of the shank, nearer to the first wall of the receiver, facilitates removal of the ball to allow removal of the shank from the receiver.

15 Claims, 6 Drawing Sheets

RELEASABLE LOCKING MECHANISM FOR THE SHANK OF A KNIFE OR OTHER IMPLEMENT

CROSS REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION (1) Field of the Invention

This invention relates to the field of knives and other implements having blades (or other features) that are replaceable with the same or different blades (or other features). More particularly, this invention relates to handles that accept and hold a standardized shank portion of a blade or other useful feature. More specifically, the handle may accept and hold a blade such as (for example) a blade commonly known as a "utility" blade or a "box cutter" blade.

(2) Description of Related Art Including Information Disclosed 37 CFR 1.97 and 1.98

The present invention relates to knives and other implements that have blades or other features that are removable. Many implements have blades or other features that are removable because they dull or otherwise wear out. Alternatively, many implements allow substitution of parts that have uses that differ from the substituted part, such as the substitution of a flat-head screwdriver head for a Phillips-head screwdriver head. There is a need for a simpler and better manner of readily releasing an existing blade or other feature, and locking in a new or substitute blade or other feature for use with the remainder of the knife or implement.

Known in the art are various releasable blade-locking knife handles. The following patents are arguably related to the patentability of the subject invention:

| U.S. Pat./App. No. | 1st Inventor Named | Date of Patent/Publication |
|---|---|---|
| 4,777,725 | Hirsch | Oct. 18, 1988 |
| 5,575,071 | Phillips | Nov. 19, 1996 |
| 5,903,983 | Jungmann | May 18, 1999 |
| 6,260,281 | Okumura | Jul. 17, 2001 |
| 6,453,565 | Phillips | Sep. 24, 2002 |
| 6,546,633 | Lovell | Apr. 15, 2003 |
| 6,612,039 | Kakiuchi | Sep. 2, 2003 |
| 7,040,023 | Nemazi | May 9, 2006 |
| 7,107,690 | Lui | Sep. 19, 2006 |
| 2005/0252010 | Freeman | Nov. 17, 2005 |

U.S. Pat. No. 5,575,071 issued to Phillips discloses a cylindrical blade carrier with a free end having a slot along its central longitudinal axis for receiving the shank of a blade; the shank has a hole aligned with a bore through the sidewall of the blade carrier. Attached around the free end of the blade carrier is a tubular clamp member, for rotation from a 1st position (pushing the ball into seating against the blade hole perimeter to secure the blade to the carrier) to a 2nd position (allowing the ball to un-seat from the blade hole, releasing the blade from the carrier). U.S. Pat. No. 6,453,565 issued to Phillips may be considered comparable to that earlier patent.

Published U.S. patent application Ser. No. 10/847,239 of Freeman discloses a knife having an exchangeable blade, in which the knife handle includes a ball-and-spring mechanism causing the ball to press the blade against the handle wall when the blade is in the cutting position.

U.S. Pat. No. 6,260,281 issued to Okumura discloses a device for mounting a blade on a blade carrier, including a blade pressing member for pressing a blade against a surface of a blade carrier to fix the blade to the carrier; an "operation member" moves the pressing member from that blade-fixed position to a blade-release position by means of a ball interposed between a blade pressing member and the "operation member". The ball essentially rolls along a surface between those two structural elements, releasing the pressure pushing the blade against the carrier.

U.S. Pat. No. 5,903,983 issued to Jungmann discloses a spindle with a slot for receiving a blade (having a hole in the tang), and blade clamping means for firmly engaging the blade at the blade hole and at two other spots to provide a rigid 3-point support for the blade so affixed within the spindle. One embodiment includes a metallic ball as a blade-engaging member, fixed within a recess so that a portion extends to engage the blade hole.

Those patents do not disclose a ball essentially extending freely through a blade hole while seating in the rim of a hole in an adjacent wall of the blade shank receiver, functioning as either a locking mechanism or a release mechanism depending upon the positioning of the equator of the ball relative to the blade. Neither do those patents disclose use of the blade itself as the part of the lock/release mechanism that either locks the blade more firmly or releases the blade from the receiver. Those patents also do not disclose a magnetized ball having (in a resting position seated in the ball-stop hole within the clevis) its channel equator on the side of the blade nearer to the ball-stop wall. Neither do those patents disclose a means of repositioning the ball so that its channel equator is on the side of the blade nearer to the pass-thru wall.

Rather than pressing against the side surface of a blade to lock it in place by pinning it against a nearby wall, the present invention uses a ball essentially extending freely through the hole of the blade to capture it within a clevis-like receiver; and when the ball is repositioned a small distance, it readily allows the release of the blade as desired.

BRIEF SUMMARY OF THE INVENTION

The present invention generally provides a releasably locking mechanism for locking and releasing the shank of a blade or other implement snugly within a receiver. Although the present invention has several embodiments, the invention is essentially a mechanism allowing an element (such as the shank of a knife blade) to be affixed into a handle or other receiver, essentially locked in place for use, yet readily releasable and replaceable when desired.

One primary point of novelty of the invention is essentially an improved and modified clevis and pin mechanism, replacing the pin with an orb that may function as either a locking mechanism or a releasing mechanism. When the orb is a magnetic ball, and the clevis includes a seating eyelet that attracts the magnetic ball, the invention provides a mechanism that is naturally biased in a locking configuration, but which may easily be converted to a releasing mechanism when desired.

A clevis is essentially a structural member having opposing sides or walls (such as a plate appearing essentially U-shaped in cross-section, defining an interior channel); there is a pair of aligned holes through the opposing walls (through which a pin or bolt may be inserted). An element (such as the shank of a blade) with an aligned aperture (allowing passage of the pin) may be positioned in the channel between the opposing walls, with its pass-thru aperture aligned concentrically with the pair of holes in the opposing walls, so that a pin may be inserted through all three to essentially capture the element within the clevis. The present invention essentially replaces the pin with a ball (or other three dimensional body capable of functioning as such an orb), which passes through a larger hole (pass-thru portal) in the first wall (the pass-thru wall), yet seats in the smaller hole (ball-stop eyelet) in the opposite second wall (ball-stop wall) while extending essentially freely through the pass-thru aperture of the shank or other element.

The dimensions of the channel, relative to the shank snugly received therein, constitute another primary point of novelty. The ball's largest circumference is its equator, and the convergence (or narrowing) of the ball's circumferential surface (away from its equator) has the ability to act as either a shank-locking mechanism or a shank-releasing mechanism, depending upon which hemisphere of the ball is contacted by the perimeter of the pass-thru aperture in the shank. The positioning of the channel equator of the ball (paralleling the longitudinal axis of the channel between the two opposing walls), relative to the shank snugly received within the channel, determines whether the ball acts as a locking mechanism or a releasing mechanism. Such positioning is determined by the dimensions of the channel relative to the shank snugly received therein.

With the ball fully seated in the ball-stop eyelet in the ball-stop wall of the receiver, the channel equator of the ball ideally should be positioned on the side of the shank nearer to the ball-stop wall if locking of the shank within the receiver is desired. In such positioning, the hemisphere of the ball closest to the pass-thru wall of the receiver essentially defines a converging surface (from its channel equator on the opposite side of the shank, to the pole nearer to the pass-thru wall); accordingly, attempted removal of the shank from the channel essentially causes the perimeter of the shank's pass-thru aperture to contact the converging surface of the ball nearer the pass-thru wall of the receiver. That convergence essentially attempts to shunt the ball toward the ball-stop wall, to thereby force the ball further into its seating against the ball-stop eyelet in the ball-stop wall. This force locks the shank more firmly into the receiver. Removal of the shank would require a force sufficient to shear or cleave the ball, absent repositioning of the ball's channel equator.

Easy removal of the ball from the receiver may be accomplished by unseating the ball from the ball-stop eyelet, and repositioning it so that its channel equator is essentially on the side of the shank nearer the pass-thru wall of the receiver. After such repositioning, movement of the shank essentially causes the perimeter of the shank's pass-thru aperture to contact the converging surface of the ball nearer the ball-stop wall of the receiver. That convergence essentially shunts the ball toward and substantially through the pass-thru portal of the pass-thru wall of the receiver. With the ball substantially removed from the receiver, the shank may be easily removed from the channel of the receiver.

One version of the invention includes a ball that is magnetized, especially having the super-strong magnetism of a "rare-earth magnet"; the perimeter of the ball-stop wall defining the ball-stop eyelet is metal attracting the magnetic ball, so that the ball naturally seats in that attractive eyelet. Accordingly, the receiver is naturally biased in the locked configuration with any shank received within it.

The mechanism for releasably locking a shank into a receiver can be disassembled with the bare hands, without any tools. There are only three parts, two of which (the receiver and shank) are essentially common to all such implements. Moreover, there is no mechanical linkage between the parts to malfunction, wear out or break.

One primary object of the present invention is to provide a simple releasable locking mechanism.

Another primary object of the present invention is to provide a releasable locking mechanism having the strength to prevent removal of a shank of a blade or other feature of an implement, without greatly increasing the complexity or weight of the implement.

It is another object of the present invention to provide a releasable locking mechanism that itself may readily be replaced without disassembling or otherwise altering the implement.

Other objects will be apparent from a reading of the written description disclosed herein, together with the claims.

BRIEF DESCRIPTION OF THE SEVERAL VIEWS OF THE DRAWINGS

FIGS. 1 through 18 illustrate certain details of certain embodiments. However, the invention disclosed herein is not limited to only the embodiments so illustrated. The invention disclosed herein may have equally effective or legally equivalent embodiments.

DETAILED DESCRIPTION OF THE INVENTION

Figure 1:
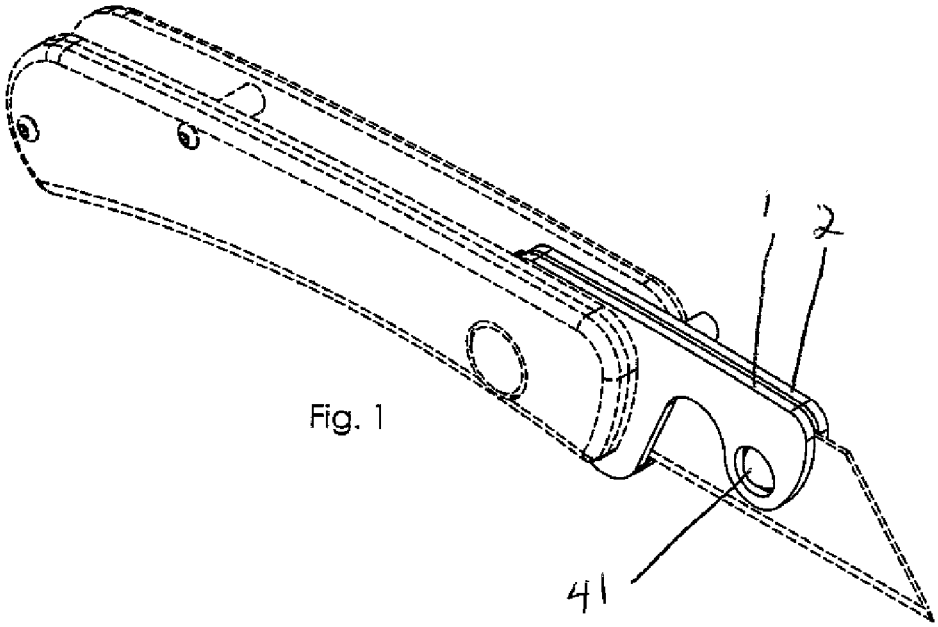
FIG. 1 depicts a perspective view of a first side (pass-thru portal side) of a representative knife handle (in phantom) with its blade shank receiver in locked configuration, with a typical blade (in phantom) inserted and the first-side pole (41) of the seated ball visible through the pass-thru portal.
Figure 2:
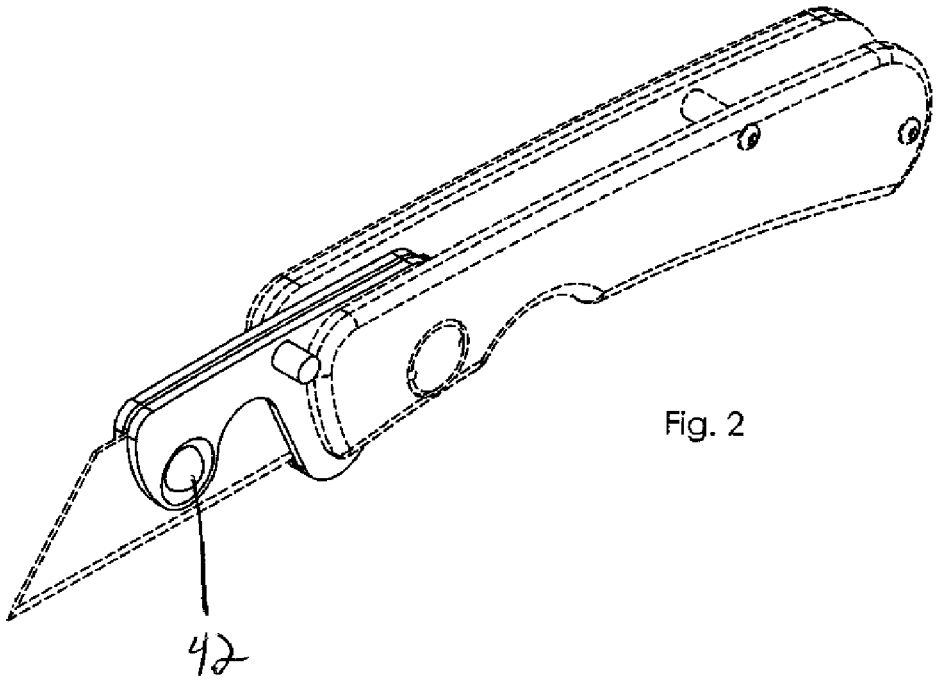
FIG. 2 depicts a perspective view of a second side (ball-stop eyelet side) of the knife handle (in phantom) with the blade shank receiver depicted in FIG. 1, with a typical blade (in phantom) inserted and the second-side pole (42) of the seated ball visible through the ball-stop eyelet.
Figure 3:
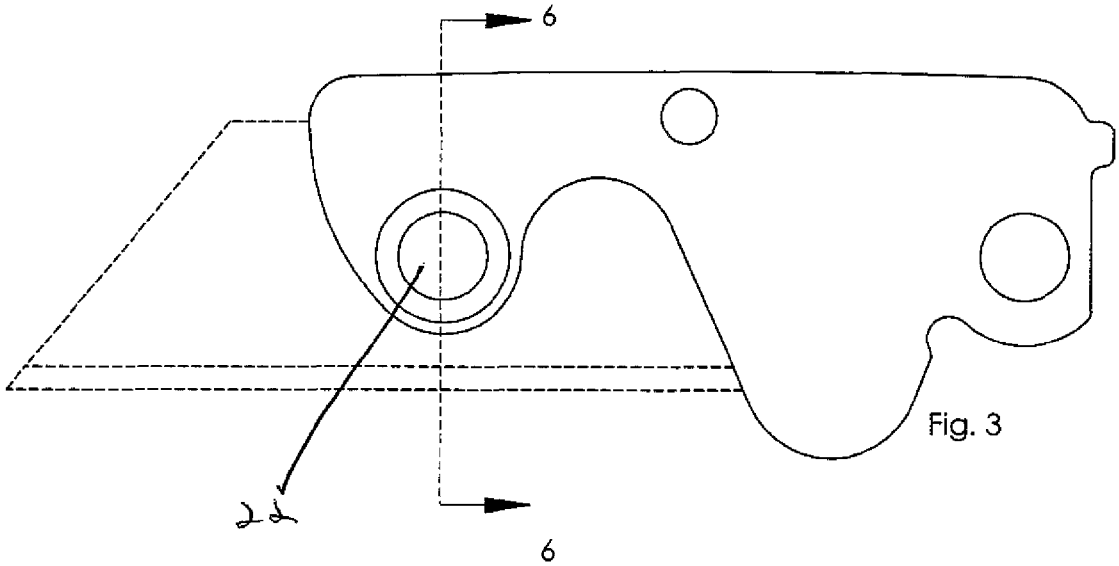
FIG. 3 depicts a side elevation view of the second (ball-stop eyelet, 22) side of the blade shank receiver of FIG. 2, in isolation.
Figure 4:
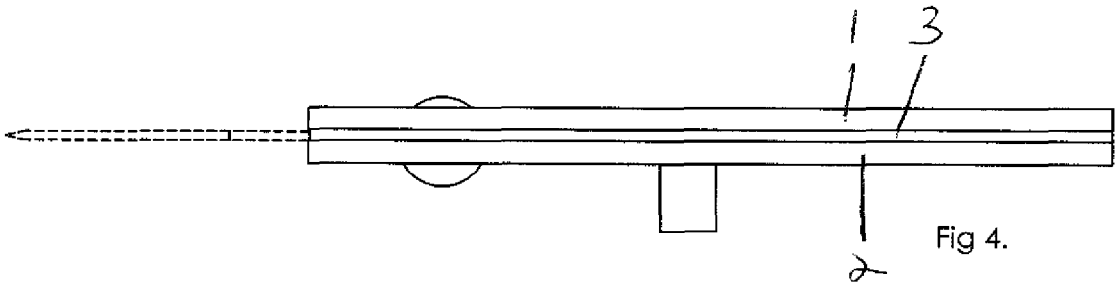
FIG. 4 depicts a top plan view of the blade shank receiver, blade (in phantom) and ball depicted in FIG. 2, with the ball seated in the ball-stop eyelet.
Figure 5:
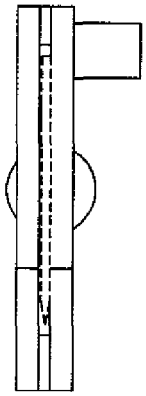
FIG. 5 depicts a front elevation view of the blade shank receiver, blade (in phantom) and ball depicted in FIG. 4, looking rearward from tip of blade.
Figure 6:
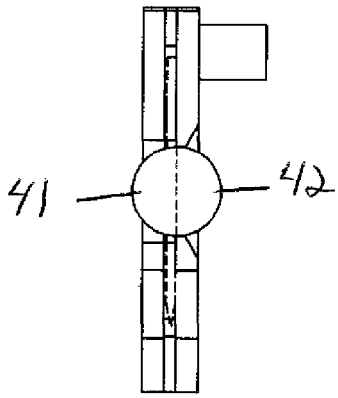
FIG. 6 depicts a cross section view of the blade shank receiver, ball and blade (in phantom) depicted in FIG. 5, sectioned at plane 6-6 of FIG. 3, with the cross section of the channel equator of the ball shown in dashed line.
Figure 8:
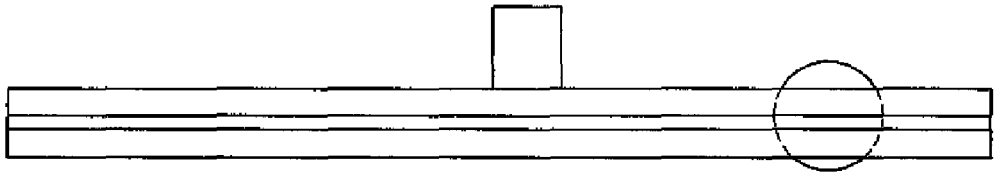
FIG. 8 depicts a top plan view of the blade shank receiver depicted in FIG. 1, with ball seated in the ball-stop eyelet.
Figure 7:
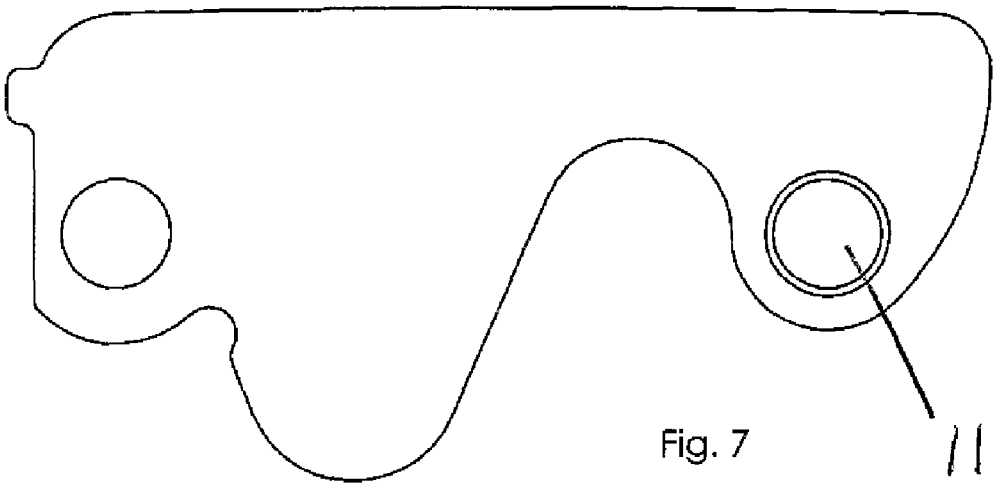
FIG. 7 depicts a side elevation view of the first (pass-thru portal, 11) side of the blade shank receiver of FIG. 1, in isolation.
Figure 9:
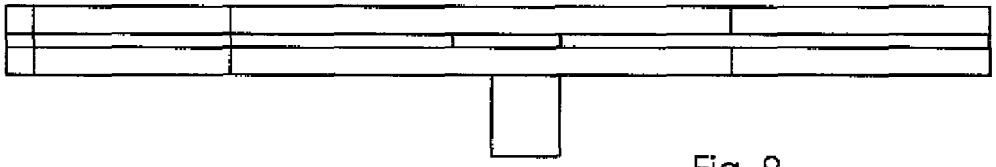
FIG. 9 depicts a bottom plan view of the blade shank receiver depicted in FIG. 8.
Figure 10:
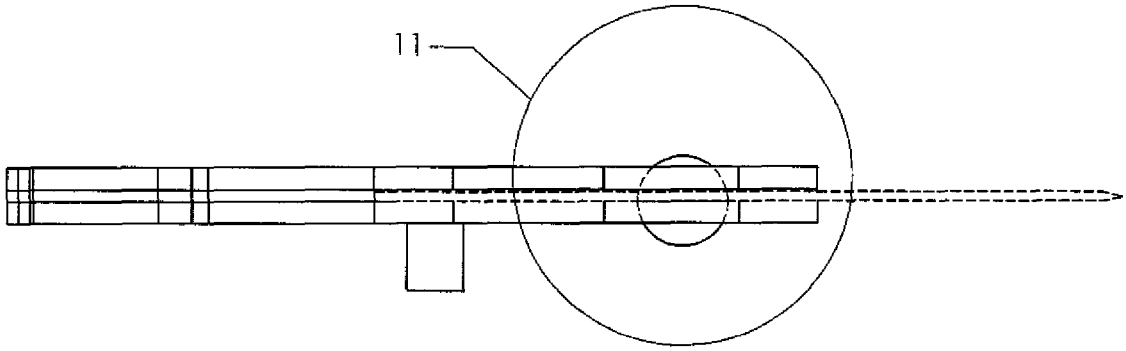
FIG. 10 depicts a bottom plan view of the blade shank receiver and ball of FIG. 8, and with a blade (in phantom).
Figure 11:
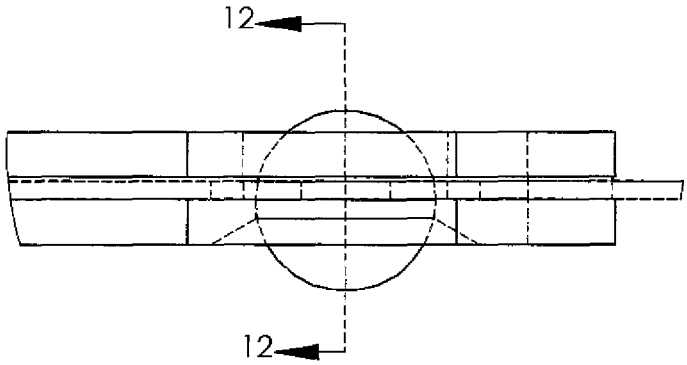
FIG. 11 depicts a magnified partial see-through view of the area encircled in circle 11 of FIG. 10, with the channel equator of the ball situated on the ball-stop eyelet side of the blade (in phantom).
Figure 12:
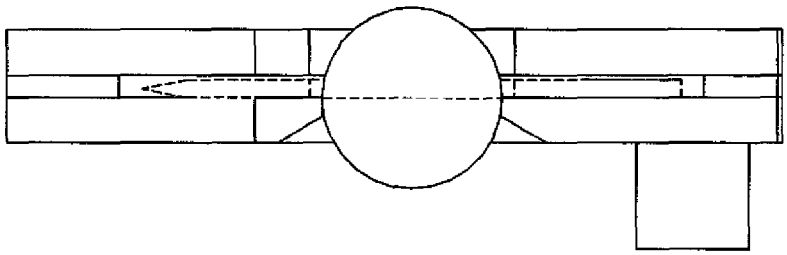
FIG. 12 depicts a cross section view of the blade shank receiver, ball and blade (in phantom) depicted in FIG. 11, sectioned at plane 12-12 of FIG. 11, with the cross section of the channel equator shown in dashed line.
Figure 13:
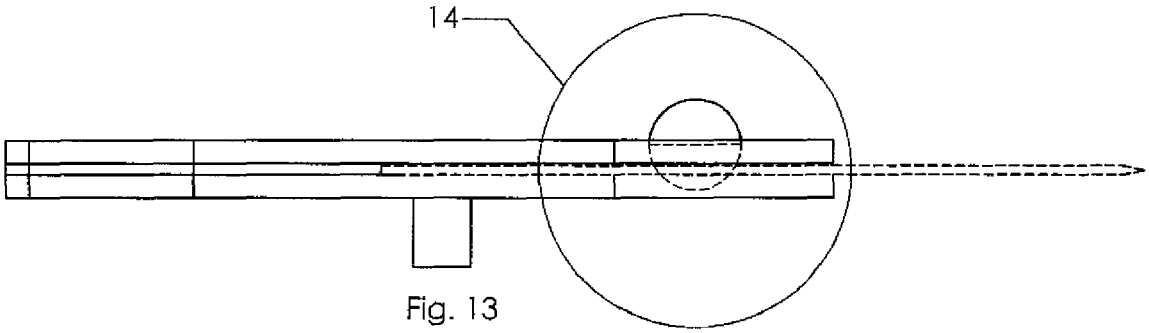
FIG. 13 depicts a bottom plan view of the blade shank receiver, ball and blade (in phantom) depicted in FIG. 10, in a releasable configuration (with the ball situated back toward the pass-thru portal, and depicting the channel equator of the ball situated on the pass-thru portal side of the blade (in phantom).
Figure 14:
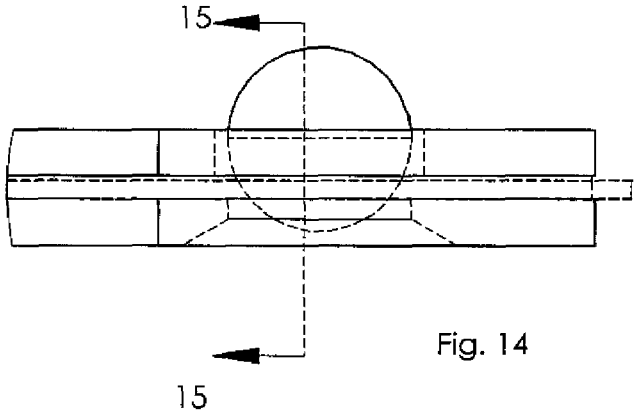
FIG. 14 depicts a magnified partial view of the area encircled in circle 14 of FIG. 13, with the channel equator of the ball situated on the pass-thru portal side of the blade (in phantom).
Figure 15:
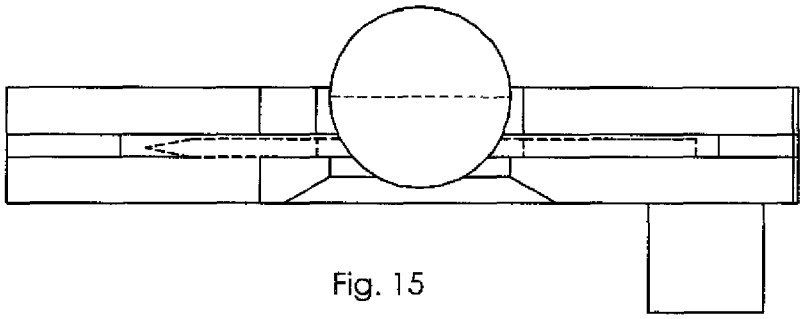
FIG. 15 depicts a cross section view of the blade shank receiver, ball and blade (in phantom) depicted in FIG. 14, sectioned at plane 15-15 of FIG. 14, with the cross section of the channel equator shown in dashed line.
Figure 16:
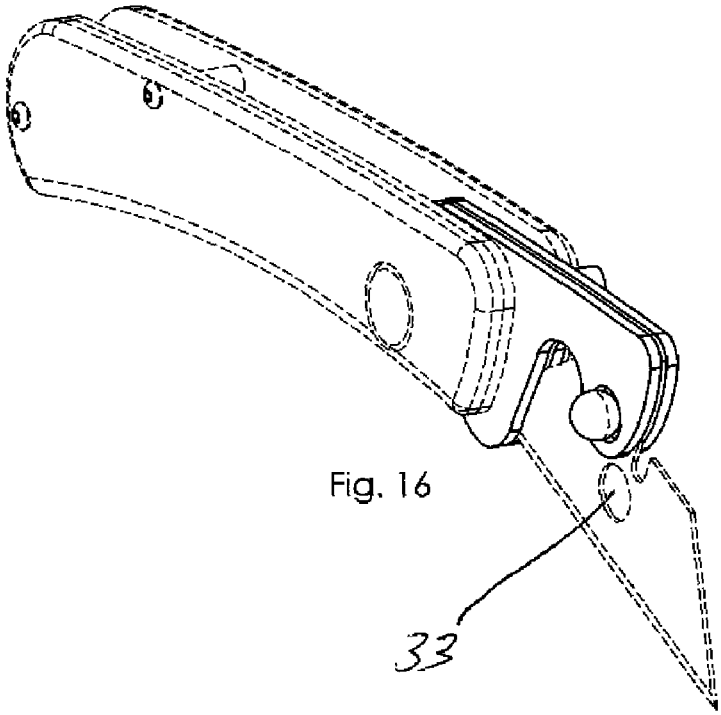
FIG. 16 depicts a perspective view of the first side (pass-thru portal side) of a knife handle (in phantom) with its blade shank receiver in a blade removal configuration, with the blade (in phantom) partially removed so that the blade hole (33) is visible outside the blade shank receiver, and with the ball magnetically attached to the remainder of the blade within the pass-thru portal.
Figure 17:
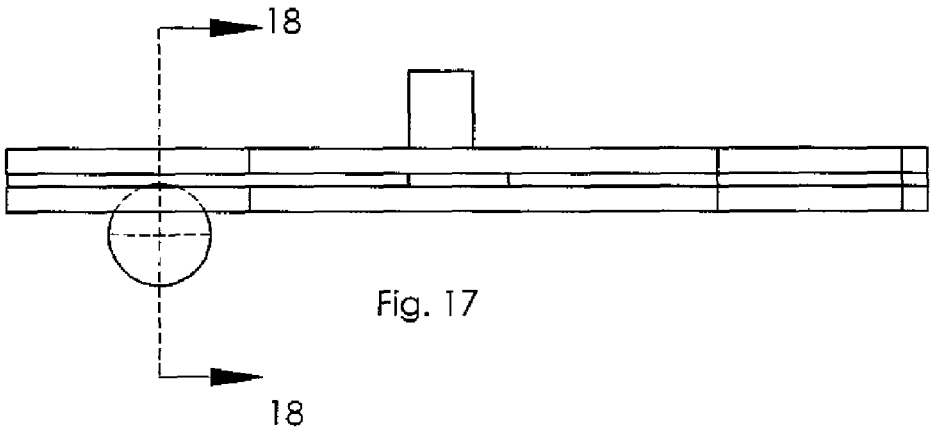
FIG. 17 depicts a top plan view of the blade shank receiver of FIG. 16, in isolation.
Figure 18:
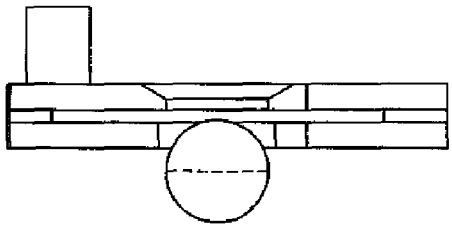
FIG. 18 depicts a cross section view of the blade shank receiver and ball depicted in FIG. 17, sectioned at plane 18-18 of FIG. 17, with the cross section of the channel equator of the ball shown in dashed line.

For the sake of simplicity and to give the claims of this patent application the broadest interpretation and construction possible, the following definitions will apply:

The term "channel equator" or derivative thereof essentially means the equatorial circumference of a ball along the length of the shank or other feature of a blade or other implement snugly received within a channel between opposing walls of the receiver.

The term "ball" essentially means an orb having a channel equator and opposite poles, each hemisphere of which defines a converging circumferential surface from the channel equator to a pole; "ball" may also include any other three-dimensional form or body containing an opposite pair of essentially circumferential surfaces that converge away from the larger circumferential surface functioning as a channel equator, such opposite converging essentially circumferential surfaces functioning as the hemispheric converging circumferential surfaces of an orb.

The term "shank" essentially means the shank or other feature of a knife blade or other implement, having a cross-section capable of being snugly accepted by a channel for mounting or similar attachment for use.

The term "bottom" essentially means from the perspective of the essentially horizontal cutting edge of the knife blade, when the cutting edge is facing downward.

The term "top" essentially means from the perspective of opposite the essentially horizontal cutting edge of the knife blade, when the cutting edge is facing downward.

The term "front" essentially means from the perspective of the tip of the knife blade (or the receiver).

The term "rear" essentially means from the perspective opposite of the tip of the knife blade (or the receiver).

The term "rare-earth magnet" essentially means a magnet having extremely strong magnetic qualities, including those made from samarium-cobalt materials and those made from neodymium-iron-boron materials.

Also for the sake of simplicity, the conjunctive "and" may also be taken to include the disjunctive "or," and vice versa, whenever necessary to give the claims herein the broadest interpretation and construction possible. Likewise, when the plural form is used, it may be taken to include the singular form, and vice versa.

To lock a shank into the receiver, before the ball is inserted through the receiver's pass-thru portal, the shank slides into the channel space between the pass-thru wall and the ball-stop wall, with little room to spare. When the ball is inserted through the pass-thru portal (and pass-thru aperture of the shank), the magnetized ball is naturally attracted into continuing magnetic contact with the marginal perimeter of the ball-stop eyelet; at this time, the channel equator of the ball is ideally situated on the side of the shank nearer to the ball-stop wall, with a polar area of the ball protruding slightly through the ball-stop eyelet or the outer indentation or beveling of the ball-stop wall forming the outer perimeter of the ball-stop eyelet.

When in the locking configuration, shank pressure applied to the pass-thru side hemisphere of the ball (by the perimeter of the shank's pass-thru aperture, during attempted removal of the shank) attempts to push or shunt the ball towards the ball-stop eyelet; since the ball is already in magnetic contact with the periphery of the ball-stop eyelet, such added pushing essentially seats the ball more firmly in the ball-stop eyelet, making it more difficult to remove the shank from the receiver.

Conversely, for removal of the shank, finger-pressure against the ball's polar area protruding into (or perhaps through) the ball-stop eyelet will unseat and shift the ball so that its channel equator becomes repositioned to the opposite side of the shank, nearer to the pass-thru wall of the receiver. Shank pressure applied to the ball-stop side hemisphere of the ball (by the perimeter of the shank's pass-thru aperture, during removal of the shank) pushes or shunts the ball towards and at least partially thru the pass-thru portal in the pass-thru wall, allowing complete removal of the shank. Converting the ball from a shank-locking mechanism to a shank-releasing mechanism is accomplished by pushing the polar area of the ball protruding into (and perhaps through) the ball-stop eyelet until the channel equator is on the side nearer the pass-thru wall of the receiver.

The ball's magnetic properties, especially of a super-magnetic "rare-earth magnet", assure that the shank is locked into place in its natural resting position (with the ball seated in the ball-stop eyelet), and assures that the ball will remain in contact with the metallic receiver after the shank is removed. Rare-earth magnets were not generally available until the patenting of a process for making a permanent rare-earth magnet. (U.S. Pat. No. 3,982,971 issued in 1976.) Before then, to the extent that the present invention was physically possible using conventional strength magnets, it was not practical to do so because of the ease with which the ball could become unseated. Such unseating and repositioning of the ball would be entirely undesirable; and in the context of knife blade shanks, such unseating would be dangerous. The advent of rare-earth magnets greatly increased the magnetism of the ball, enough to indirectly or synergistically endow the ball with utility as a lock/release switching mechanism.

Although the disclosed invention has a number of features and embodiments, in most general terms it comprises (includes) a releasably locking mechanism for locking and releasing the shank of a blade or other implement snugly within a receiver, using an aperture in the shank in a novel manner. Many known replaceable or disposable knife blades have a shank that includes a hole, invariably impaled by an anchoring screw or (as noted in the aforementioned patents) providing a seating for an anchoring device such as a ball. In the present invention, the shank includes an aperture allowing passage of the circumference of a ball therethrough when the shank is received within the receiver, especially when the shank is fully and snugly received within the channel of the receiver (in the position most desired for use). The releasable locking mechanism disclosed herein includes a receiver having a cooperating pair of parallel walls defining a channel receiving the shank. The walls include a pass-thru wall defining a pass-thru portal allowing passage of the circumference of the ball therethrough; the receiver also includes a ball-stop wall defining a smaller ball-stop eyelet aligned concentrically with the portal and the aperture, the eyelet having a periphery sized for seating the ball. Typically the ball-stop wall and its eyelet are metal attracting the magnetized ball bearing; the pass-thru wall may also be metal.

The mechanism further includes the ball seating against the eyelet so that the channel equator of the ball is positioned on the side of the shank nearer the ball-stop wall; since the shank typically fits relatively snugly within the channel, with very little space between the shank and the nearest adjacent wall of the channel, the channel equator of the seated ball may be positioned in the eyelet hole, within the planes formed by the inner and outer surfaces of the ball-stop wall. The primary requirement for locking is that the channel equator of the ball not be on the opposite side of the shank, nearer the pass-thru wall of the receiver.

The locking mechanism disclosed herein may further include a means of biasing the ball toward the seating positioning. In the preferred embodiment of the invention, the means of biasing the ball toward the seating position includes magnetism between the ball and the ball-stop eyelet. Preferably the magnetism results from a magnetic field of the ball; and the eyelet is metal, to which the ball is attracted; typically the receiver is steel or another metal having a good attraction to the magnetized ball bearing. However, the magnetism may result from a magnetic field of the ball-stop eyelet rather than the ball. When the ball is magnetized, it is especially useful for it to have an extremely strong magnetism, such as that becoming commonly known as "rare-earth magnets".

Besides the receiver and the ball, and any magnetism, the mechanism may also include the shank received within the receiver, having a pass-thru aperture for allowing the ball to seat against the ball-stop eyelet. And movement of the shank is helpful, although not necessary, for removal of the ball from the channel to allow release of the shank when desired. Any removal of the ball from the channel typically must begin with a means of unseating the ball from the ball-stop eyelet.

One such means includes a protrusion member sized to contact the pole of the ball nearer to the ball-stop wall, to urge the ball with sufficient force to overcome the magnetism and unseat the ball; almost anything may function as a protrusion member, to the extent that it can contact the pole of the ball within the ball-stop eyelet and push the ball toward the pass-thru portal in the pass-thru wall. Another convenient version includes beveling the outer surface of the ball-stop wall around the ball-stop eyelet, essentially forming an indentation on the outer surface of the ball-stop wall sufficient to facilitate contact by the user's fingertip against the pole of the ball typically within the ball-stop eyelet; in this way, the user may use a finger to urge the ball with sufficient force to overcome the magnetism, unseating the ball and pushing it toward the pass-thru portal, repositioning the ball so that the channel equator of the ball is on the side of the shank nearer the pass-thru wall.

To assist removal of the ball from the channel, the means of releasing the shank from the receiver may further include the shank itself. The movement of the shank, typically in the direction for removing it from the receiver, essentially causes the perimeter of its pass-thru aperture to contact the converging surface of the ball and shunt it toward (and substantially through) the pass-thru portal. The magnetism usually causes the ball to maintain magnetic connection with the receiver following passage of the ball through the pass-thru portal. Since the ball therefore remains "stuck" to the receiver (or the removed shank), there is less likelihood that it will become lost. This is especially true if the magnetism is produced by a super-strong rare earth-magnet.

In one specific embodiment of the releasably locking mechanism for snugly locking and releasing a shank of a blade or other implement within a receiver, the receiver includes a cooperating pair of parallel walls (1 and 2) defining a channel (3) receiving the shank; the walls include a pass-thru wall (1) defining an essentially circular pass-thru portal (11) allowing passage of the circumference of a ball therethrough, and a ball-stop wall (2) defining a smaller ball-stop eyelet (22) aligned concentrically with the pass-thru portal, the eyelet having a periphery sized for seating the ball. Also included is the shank defining a pass-thru aperture (33) allowing passage of the circumference of the ball therethrough when the shank is received within the receiver. Also included is the magnetized ball (4) seating against the magnetically attracted eyelet so that the channel equator of the ball is positioned on the side of the shank nearer the ball-stop wall, and with the pole (42) of the ball nearer the ball-stop wall protruding within the ball-stop eyelet. This specific version typically includes the ball-stop wall having an outer surface with beveling around the ball-stop eyelet sufficient to facilitate contact by the user's fingertip against the pole of the ball within the ball-stop eyelet, and urging of the ball with sufficient force to overcome the magnetism and reposition the ball so that the channel equator of the ball is on the side of the shank nearer the pass-thru wall.

Besides the embodiments described above, the invention also includes a method of using one of the mechanisms disclosed herein. Typically the method of use includes the step of urging the ball into the pass-thru portal and pass-thru aperture, seating it against the ball-stop eyelet. When the ball is magnetized, the seating step is augmented by the magnetism; as soon as the ball approaches the eyelet, the magnetic attraction between them draws the ball into magnetic contact seating against the eyelet, where it will remain until sufficient force separates them.

The method of use may further include the releasing steps of unseating the ball from the eyelet enough to reposition the channel equator of the ball to the side of the shank nearer to the pass-thru wall. The method of use may further include the additional step of moving the shank sufficient to essentially cause the perimeter of its aperture to shunt the ball toward and substantially through the pass-thru portal. The shank may then be removed, and replaced with another.

We claim:

1. A method of releasably locking a shank of an implement into a receiver, comprising the step of providing a locking mechanism having the shank having a pass-thru aperture allowing passage of a circumference of a magnetized ball therethrough when the shank is received within the receiver, said receiver comprising a cooperating pair of parallel walls defining a channel receiving the shank, said walls including a pass-thru wall defining a pass-thru portal allowing passage of the circumference of said ball therethrough, and a ball-stop wall defining a smaller ball-stop eyelet aligned concentrically with said portal and the aperture, said eyelet having a periphery sized for seating said ball, said mechanism further comprising said ball seating against said eyelet so that the channel equator of said ball is positioned on the side of the shank nearer the ball-stop wall, said mechanism further comprising a means of biasing said ball toward said seating, said method of use further comprising the step of urging the ball into the pass-thru portal and pass-thru aperture, seating it against the ball-stop eyelet, said seating including magnetic attraction.

2. A method of use described in claim 1 above, further comprising the releasing steps of unseating the ball from the eyelet enough to reposition the channel equator of the ball to the side of the shank nearer to the pass-thru wall, then moving the shank sufficient to essentially cause the perimeter of its aperture to shunt the ball toward and substantially through the pass-thru portal.

3. A method of use described in claim 2 above, said ball-stop wall having an outer surface including beveling around the ball-stop eyelet, said unseating achieved by the user's fingertip contacting the pole of the ball protruding through the ball-stop eyelet.

4. A releasably locking mechanism for locking and releasing a shank of an implement snugly within a receiver, said shank having a pass-thru aperture allowing passage therethrough of a ball having opposite poles and an equator around a circumference, said mechanism comprising said receiver having a cooperating pair of parallel walls defining a channel receiving said shank, said walls including a pass-thru wall defining a pass-thru portal allowing passage of the circumference of said ball therethrough, and a ball-stop wall defining a smaller ball-stop eyelet aligned concentrically with said portal, said eyelet having a periphery sized for seating said ball, said mechanism further comprising said shank received within said channel and having the pass-thru aperture allowing passage therethrough of said ball equator, said ball seating against said eyelet so that said equator is positioned within said channel on the side of said shank nearer said ball-stop wall, said mechanism further comprising a means of biasing said ball toward said seating comprising magnetic attraction between said ball and said ball-stop eyelet.

5. A mechanism described in claim 1 above, said magnetic attraction resulting from a magnetic field of said ball, and said eyelet is metal attracted by said magnetic field.

6. A mechanism described in claim 1 above, said magnetic attraction resulting from a magnetic field of said ball-stop eyelet, and said ball is attracted by said magnetic field.

7. A mechanism described in claim 1 above, further comprising a means of releasing said shank from said receiver, said means of releasing said shank comprising a means of unseating said ball from said ball-stop eyelet.

8. A mechanism described in claim 7 above, said ball-stop wall having an outer surface, said means of unseating said ball comprising beveling of said outer surface around said ball-stop eyelet sufficient to facilitate contact by the user's fingertip against the pole of the ball nearer to said ball-stop wall and urging of said ball with sufficient force to overcome said magnetic attraction and unseat said ball.

9. A mechanism described in claim 7 above, said means of unseating facilitating repositioning said ball so that the channel equator of said ball is on the side of the shank nearer the pass-thru wall.

10. A mechanism described in claim 7 above wherein the movement of said shank essentially causes the perimeter of said aperture to contact the converging surface of said ball and shunt it toward and mostly through said pass-thru portal.

11. A mechanism described in claim 10 above, said magnetic attraction essentially causing said ball to maintain magnetic connection with said receiver after passage of said ball through said pass-thru portal.

12. A releasably locking mechanism for snugly locking and releasing a shank of an implement within a receiver, said mechanism comprising:

(a) said receiver comprising a cooperating pair of parallel walls defining a channel receiving said shank, said walls including a pass-thru wall defining an essentially circular pass-thru portal allowing passage of a circumference of a ball therethrough, and a ball-stop wall defining a smaller ball-stop eyelet aligned concentrically with said pass-thru portal, said eyelet having a periphery sized for seating said ball;

(b) said shank defining a pass-thru aperture allowing passage of the circumference of said ball therethrough when said shank is received within said receiver;

(c) said ball seating against said eyelet so that the channel equator of said ball is positioned on the side of said shank nearer said ball-stop wall, and with a pole of the ball nearer the ball-stop wall and protruding within said ball-stop eyelet; and (d) a means of biasing said ball toward said seating, comprising magnetic attraction resulting from a magnetic field of said ball.

13. A mechanism described in claim 12 above, said ball-stop wall having an outer surface, said mechanism further comprising a means of releasing said shank from said receiver, comprising beveling of said outer surface around said ball-stop eyelet sufficient to facilitate contact by the user's fingertip against the pole of the ball within said ball-stop eyelet and urging of said ball with sufficient force to overcome said magnetic attraction and reposition said ball so that the channel equator of said ball is on the side of the shank nearer the pass-thru wall.

14. A mechanism described in claim 13 above, said means of releasing said shank from said receiver further comprising moving said shank sufficient to essentially cause the perimeter of its aperture to contact the converging surface of said ball and shunt it toward and mostly through said pass-thru portal.

15. A mechanism described in claim 14 above, said magnetic attraction essentially causing said ball to maintain magnetic connection with said receiver after passage of said ball through said pass-thru portal.

* * * * *